US006537037B2

(12) United States Patent
Ota et al.

(10) Patent No.: US 6,537,037 B2
(45) Date of Patent: Mar. 25, 2003

(54) VARIABLE DISPLACEMENT COMPRESSOR AND AIR CONDITIONING APPARATUS

(75) Inventors: Masaki Ota, Kariya (JP); Masahiro Kawaguchi, Kariya (JP); Ken Suitou, Kariya (JP); Ryo Matsubara, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 30 days.

(21) Appl. No.: 09/760,352

(22) Filed: Jan. 12, 2001

(65) Prior Publication Data

US 2001/0014287 A1 Aug. 16, 2001

(30) Foreign Application Priority Data

Jan. 14, 2000 (JP) ..... 2000-006800

(51) Int. Cl.[7] ..... F04B 49/00

(52) U.S. Cl. ..... 417/213; 417/270; 137/487.5; 62/228.5

(58) Field of Search ..... 417/213, 222.2, 417/269, 270; 62/133, 196.3, 228.3, 228.5; 137/565.16, 487.5; 251/129.15, 61.5

(56) References Cited

U.S. PATENT DOCUMENTS 4,864,832 A * 9/1989 Suzuki ..... 62/133
5,117,643 A * 6/1992 Sakurai et al. ..... 62/133
5,145,326 A * 9/1992 Kimura et al. ..... 417/222.2
5,702,235 A * 12/1997 Hirota et al. ..... 417/222.2
6,010,312 A * 1/2000 Suitou et al. ..... 417/222.2
6,200,105 B1 * 3/2001 Kawaguchi et al. ..... 417/222.2
6,260,369 B1 * 7/2001 Yokomachi et al. ..... 62/228.5
6,356,825 B1 * 3/2002 Takenaka et al. ..... 701/36

FOREIGN PATENT DOCUMENTS

JP 7-189899 7/1995

* cited by examiner

*Primary Examiner*—Charles G. Freay
*Assistant Examiner*—Han L Liu
(74) *Attorney, Agent, or Firm*—Morgan & Finnegan, LLP

(57) ABSTRACT

A variable displacement compressor is operated efficiently by avoiding inefficient conditions. The compressor varies its displacement using a control valve for which an external duty control procedure is performed. A target value for controlling the displacement is determined in accordance with the duty ratio Dt of a drive signal sent to the control valve. If the duty ratio Dt is equal to or greater than a predetermined reference value DJ, the displacement is permitted to be varied corresponding to the duty ratio Dt. If the duty ratio Dt is smaller than the reference value DJ, the variable displacement control through the duty control procedure is suspended. In this case, the compressor is operated with a nullified duty ratio (Dt=0), or a minimum displacement.

7 Claims, 9 Drawing Sheets

VARIABLE DISPLACEMENT COMPRESSOR AND AIR CONDITIONING APPARATUS

BACKGROUND OF THE INVENTION

The present invention relates to variable displacement compressors varying displacement in a range from minimum to maximum and air conditioning apparatuses incorporating the compressors.

A typical air conditioning apparatus for vehicles has a refrigerant circuit including a condenser, a pressure reducing device (for example, an expansion valve), an evaporator, and a compressor. The compressor recently adopted is often a variable displacement compressor (particularly, a swash plate type variable displacement compressor) that is flexible to meet various air-conditioning requirements. Generally, a prior-art swash plate type variable displacement compressor varies its displacement by maintaining the pressure acting on an evaporator outlet (suction pressure Ps) at a predetermined target value (target suction pressure). That is, the compressor has a displacement control valve that controls the compressor displacement in a feedback manner in accordance with the suction pressure Ps, which serves as a reference indicator, such that the displacement corresponds to the cooling load of the compressor. More specifically, a pressure sensitive member, such as a bellows or a diaphragm, detects the suction pressure Ps. The movement of the pressure sensitive member positions a valve body to adjust the opening size of the control valve. This varies the pressure (crank pressure Pc) in a swash plate chamber (crank chamber) to alter an inclination angle of the swash plate. That is, the piston stroke is varied in accordance with the inclination angle of the swash plate, which is controlled in a range from a minimum inclination angle θmin to a maximum inclination angle θmax. The compressor displacement is thus adjusted as necessary in a range from minimum to a maximum.

However, a detailed operation analysis regarding this swash plate type variable displacement compressor indicates that the compressor is not capable of ensuring a uniform operational efficiency for the entire range in which the displacement is varied. The operational efficiency of the compressor (or an air conditioning apparatus including the compressor) is represented by a coefficient of performance (COP) and is indicated by the following equation: COP=Q/L. In the equation, Q indicates refrigerating performance (heat absorbing performance of the evaporator), and L indicates the power supplied to the compressor (workload of the compressor). As the COP increases, the operational efficiency of the compressor increases.

FIG. 7 is a graph in which refrigerating performance ratio ($Q/Q_0$) is plotted along the horizontal axis (X-axis) and power ratio ($L/L_0$) is plotted along the vertical axis (Y-axis). $Q_0$ indicates a maximum refrigerating performance. If the equation $Q=Q_0$ is satisfied, the refrigerating performance ratio $Q/Q_0$ is 100%. In the same manner, $L_0$ indicates a maximum power supplied to the compressor. If the equation $L=L_0$ is satisfied, the power ratio $L/L_0$ is 100%. In the graph, a diagonal broken line extends from the origin (0, 0) to a point indicating a maximum performance: $(L_0/L_0, Q_0/Q_0)=(1, 1)$. Along this diagonal straight line, the following equation is satisfied: $Q/Q_0=L/L_0$. Based on this equation, the following equation is obtained: $Q_0/L_0=Q/L=COP$. In other words, the area located above the diagonal straight line in the graph of FIG. 7 indicates a decrease in the COP, as compared to the maximum performance COP ($COP=Q_0/L_0$).

In contrast, the area located below the diagonal straight line in the graph indicates an increased COP, as compared to the maximum performance COP ($COP=Q_0/L_0$)

As shown in FIG. 7, the graph includes three curves. The curves indicate characteristics of the swash plate type variable displacement compressor operated under different conditions regarding the suction pressure Ps and the like. The conditions are varied among the curves. As indicated by the graph, each curve crosses the diagonal straight line at a point P (referred to as the "points of divergence"). In an area of the power ratio located above each point P, as viewed in the graph, corresponding sections of the curves are located below the diagonal line. These sections of the curves thus indicate a relative increase in the COP, as compared to the maximum performance COP. In contrast, in an area of the power ratio located downward with respect to the points P, corresponding sections of the curve are located above the diagonal line. These sections of the curves thus indicate a relative reduction of the COP, as compared to the maximum performance COP. The power L supplied to the compressor increases as the inclination angle of the swash plate, or the compressor displacement, increases. Accordingly, as is clear from the graph of FIG. 7, the operational efficiency of the compressor decreases if the power supplied to the compressor is smaller than the value corresponding to the point P, or if the displacement is relatively small. Further, if the power supplied to the compressor is greater than the value corresponding to the point P, or the displacement is relatively large, the operational efficiency of the compressor is improved.

It is assumed that the lower operational efficiency during the relatively small displacement operation is caused by the following: (a) a reduced piston stroke decreases the sealing effect between the outer surface of each piston and the inner wall of the corresponding cylinder bore, thus increasing gas leakage from the cylinder bore to the crank chamber; (b) a greater amount of gas must be supplied to the crank chamber from the discharge chamber to maintain the crank pressure Pc at a relatively high level during lower displacement operation, and the amount of waste gas is increased; and (c) the proportion of mechanical power loss caused by friction for moving movable parts including the swash plate is increased during lower displacement operation.

As described, even though the compressor is capable of controlling of the displacement continuously in the entire range from minimum to maximum, this control is not necessarily advantageous regarding the operational efficiency of the compressor.

SUMMARY OF THE INVENTION

Accordingly, it is an objective of the present invention to provide a variable displacement compressor, the operational efficiency of which is improved by avoiding operation under conditions that reduce operational efficiency, and an air conditioning apparatus employing this variable displacement compressor.

To achieve the above objective, the present invention is a variable displacement compressor that varies the displacement in a variation range including a minimum displacement and a maximum displacement. The compressor includes an acquiring device for acquiring a target value used for controlling the compressor displacement, a switching device, which compares the target value with a predetermined reference value and switches an operational mode in accordance with a result from the comparison such that the displacement corresponding to the target value achieves a coefficient of performance equal to or greater than a predetermined level, and an actuator for varying the displacement in accordance with an instruction from at least the switching device.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

An embodiment of an air conditioning apparatus for vehicles according to the present invention will now be described with reference to the attached drawings.

Figure 1:
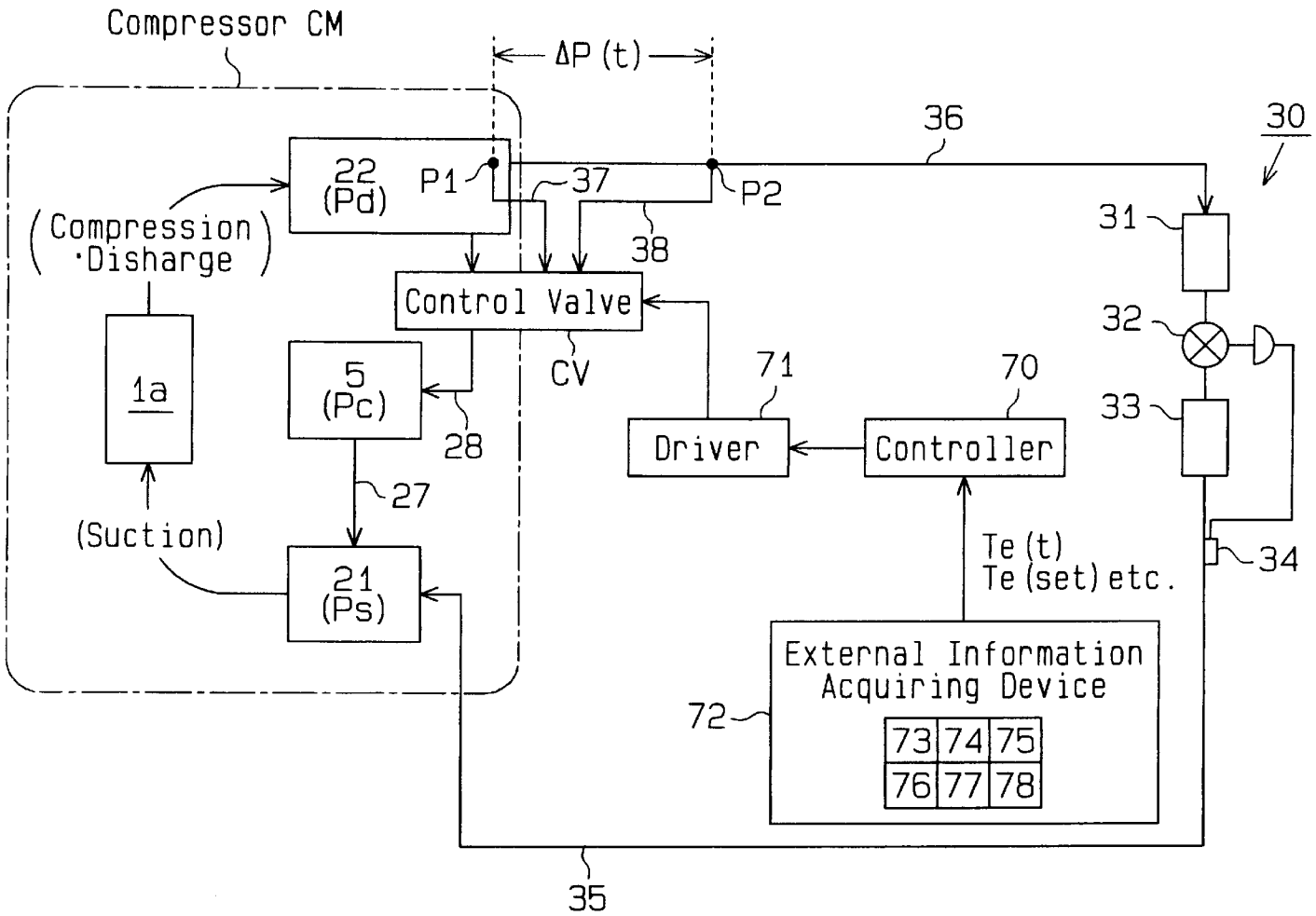
FIG. 1 is a view schematically showing an example of a refrigerant circuit of an air conditioning apparatus.

As shown in FIG. 1, the air conditioning apparatus has a refrigerant circuit (refrigerating circuit) including a swash plate type variable displacement compressor CM and an external refrigerant circuit 30. The external refrigerant circuit 30 has, for example, a condenser 31, an expansion valve 32, which is a pressure reducing device, an evaporator 33, a refrigerant passage 35, and a refrigerant passage 36. The passage 35 connects an outlet of the evaporator 33 to a suction chamber 21 of the compressor CM, and the passage 36 connects a discharge chamber 22 of the compressor CM to an inlet of the condenser 31. Refrigerant gas is supplied to the suction chamber 21 from the evaporator 33 through the passage 35. The compressor CM draws the refrigerant gas from the suction chamber 21 and compresses the gas. The compressed gas is sent to the discharge chamber 22. The high-pressure gas in the discharge chamber 22 is then supplied to the condenser 31 through the passage 36. The expansion valve 32 internally controls its opening size in a feedback manner in accordance with the temperature and pressure of refrigerant gas, which are detected by a sensor 34 located in the vicinity of the outlet of the evaporator 33. The amount of the refrigerant gas supplied from the condenser 31 to the evaporator 33 thus corresponds to cooling load of the compressor CM. In this manner, the amount of the refrigerant flowing in the external refrigerant circuit 30 is directly adjusted.

General Structure of Compressor

Figure 2:
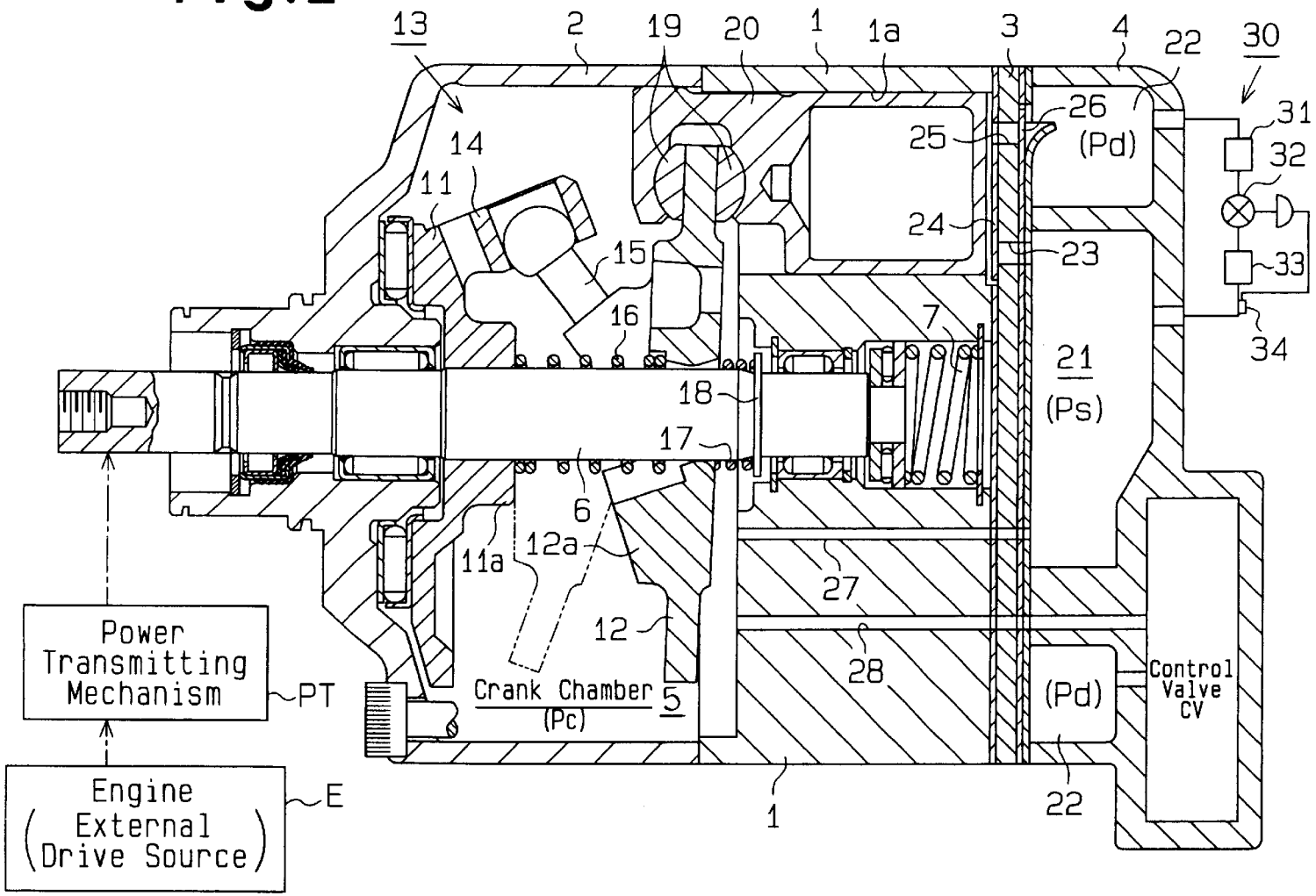
FIG. 2 is a cross-sectional view showing a swash plate type variable displacement compressor.

As shown in FIG. 2, the swash plate type variable displacement compressor CM includes a cylinder block 1, a front housing member 2, and a rear housing member 4. The front housing member 2 is secured to a front end of the cylinder block 1, which is the left end in FIG. 2. The rear housing member 4 is connected to a rear end of the cylinder block 1 with a valve plate 3 provided between the rear housing member 4 and the cylinder block 1. The cylinder block 1, the front housing member 2, the valve plate 3, and the rear housing member 4 form a housing of the compressor CM. A crank chamber 5 is formed in the housing. A drive shaft 6 extends through the crank chamber 5 and is rotationally supported by the housing.

A lug plate 11 is secured to the drive shaft 6 and rotates integrally with the drive shaft 6. The drive shaft 6 and the lug plate 11, which are integrally connected to each other, are urged toward the front housing member 2 by a spring 7 and positioned in thrust direction. The drive shaft 6 has a front end connected to an external drive source, which is an engine E of a vehicle in this embodiment, through a power transmitting mechanism PT. In this embodiment, the power transmitting mechanism PT is a clutchless mechanism that transmits power constantly (for example, a combination of a belt and a pulley). A cam plate, which is a swash plate 12 in this embodiment, is accommodated in the crank chamber 5. The swash plate 12 is operationally connected to the lug plate 11 and the drive shaft 6 by means of a hinge mechanism 13. The hinge mechanism 13 includes a pair of support arms 14 (only one is shown in FIG. 2) and a pair of guide pins 15 (only one is shown in FIG. 2).

Each support arm 14 projects from a rear side of the lug plate 11, and each guide pin 15 projects from a front side of the swash plate 12. The support arms 14 cooperate with the associated guide pins 15. The drive shaft 6 extends through a through hole formed in the swash plate 12 and contacts with the swash plate 12 by way of the through hole. Accordingly, the swash plate 12 rotates integrally with the lug plate 11 and the drive shaft 6 through the engagement by hinge mechanism 13 and the contact in the through hole. Further, the swash plate 12 inclines with respect to the drive shaft 6 while sliding axially along the drive shaft 6. An inclination angle reducing spring 16 is provided around the drive shaft 6 and extends between the lug plate 11 and the swash plate 12. The spring 16 urges the swash plate 12 toward the cylinder block 1 for decreasing the inclination angle of the swash plate 12. A return spring 17 is provided around the drive shaft 6 and extends between the swash plate 12 and a restriction ring 18 secured to the drive shaft 6. When the swash plate 12 is inclined by a maximum inclination angle (as indicated by the broken line in FIG. 2), the spring 17 does not affect the swash plate 12. However, if the inclination angle of the swash plate 12 decreases (as indicated by the solid line in FIG. 2), the return spring 17 is compressed between the swash plate 12 and the restriction ring 18. The spring 17 thus urges the swash plate 12 away from the cylinder block 1.

A plurality of cylinder bores 1*a* (only one is shown in FIG. 2) are formed in the cylinder block 1. Each cylinder bore 1*a* accommodates a single-headed piston 20, and the piston 20 moves in the cylinder bore 1*a*. A front end of each piston 20 is connected to the outer periphery of the swash plate 12 through a pair of shoes 19. The shoes 19 connect the piston 20 to the swash plate 12. Thus, when the swash plate 12 rotates integrally with the drive shaft 6, the rotation of the swash plate 12 is converted to linear movement of each piston 20. The stroke of the piston 20 corresponds to the inclination angle θ of the swash plate 12. A suction chamber 21 and a discharge chamber 22 are formed by the valve plate 3 and the rear housing member 4. The suction chamber 21 is encompassed by the discharge chamber 22. The valve plate 3 includes suction ports 23, suction valves 24 selectively opening and closing the associated suction ports 23, discharge ports 25, and discharge valves 26 selectively opening and closing the associated discharge ports 25.

Each cylinder bore 1*a* corresponds to one suction port 23 and the associated suction valve 24 as well as one discharge port 25 and the associated discharge valve 26. When each piston 20 moves from its bottom dead center to its top dead center, the refrigerant gas in the suction chamber 21 (a zone in which the suction pressure Ps acts), which is introduced from the outlet of the evaporator 33, is drawn to the cylinder bore 1*a* through the suction port 23 opened by the associated suction valve 24. The refrigerant gas in the cylinder bore 1*a* is then compressed to a predetermined pressure when the piston 20 moves from its top dead center to its bottom dead center. The compressed gas is discharged from the cylinder bore 1*a* to the discharge chamber 22 (a zone in which the discharge pressure Pd acts) through the discharge port 25 opened by the associated discharge valve 26. More specifically, when the drive shaft 6 is rotated by the power from the engine E, the swash plate 12 is rotated as inclined by an angle θ. The angle θ is defined as an angle formed between a hypothetical plane extending perpendicular to the axis of the drive shaft 6 and the swash plate 12. When the swash plate 12 is rotated, each piston 20 is moved by a stroke corresponding to the inclination angle θ of the swash plate 12. The pistons 20 repeatedly perform the above operation, which is drawing refrigerant gas to the cylinder bores 1*a*, compression of the gas, and discharge of the gas from the cylinder bores 1*a*.

The inclination angle θ is determined according to the equilibrium of various moments including a rotation moment caused by centrifugal force generated by the swash plate 12, a moment caused by the force of the spring 16 (and the spring 17), a moment caused by the force of inertia generated by reciprocating movement of each piston 20, and a gas pressure moment. The gas pressure moment is generated in accordance with the pressure in each cylinder bore 1*a* and the pressure in the crank chamber 5 (crank pressure Pc), which act on opposite sides of the piton 20. The gas pressure moment thus acts either to increase or decrease the inclination angle θ of the swash plate 12, in accordance with the crank pressure Pc. In this embodiment, the crank pressure Pc is adjusted by the displacement control valve, which will be described later, thus altering the gas pressure moment. This adjusts the inclination angle θ of the swash plate 12 to a desired value in a range from a minimum inclination angle θmin to a maximum inclination angle θmax. The maximum inclination angle θmax is mechanically determined by a counterweight 12*a* of the swash plate 12 abutting against a restricting portion 11*a* of the lug plate 11. The minimum inclination angle θmin is determined in accordance with the force of the spring 16 and the force of the return spring 17 acting against the spring 16 when the gas pressure moment is substantially maximized in the direction in which the inclination angle is decreased.

The inclination angle θ of the swash plate 12 is thus controlled in accordance with the crank pressure Pc. A mechanism for controlling the crank pressure Pc is formed by a bleed passage 27 and a supply passage 28, which both extend in the housing of the compressor, and the control valve CV, which is an actuator. The bleed passage 27 connects the suction chamber 21 to the crank chamber 5. The supply passage 28 connects the discharge chamber 22 to the crank chamber 5. The control valve CV is provided in the supply passage 28. The amount of high-pressure gas supplied to the crank chamber 5 through the supply passage 28 is altered by adjusting the opening size of the control valve CV. The crank pressure Pc is determined in accordance with the amount of gas supplied through the supply passage 28 into the crank chamber 5 and the amount of gas released through the bleed passage 27 from the crank chamber 5. If the crank pressure Pc is altered, the difference between the pressure in each cylinder bore 1*a* and the crank pressure Pc, which act on opposite sides of the associated piston 20, is also changed. The inclination angle θ of the swash plate 12 is thus altered to vary the piston stroke, or the compressor displacement.

Control Valve Controlling Compressor Displacement and Refrigerant Flow

Generally, as the compressor displacement increases and the refrigerant flow rate in the refrigerant circuit increases, the pressure loss per unit length of the circuit, or refrigerant passage, is increased. More specifically, as the refrigerant flow rate in the refrigerant circuit increases, the pressure loss (pressure difference) between a pair of pressure monitoring points P1, P2 located along the refrigerant circuit increases. Thus, the compressor displacement is detected indirectly by determining the pressure difference ΔP(t) between the points P1 and P2. In this embodiment, as shown in FIG. 1, an upstream pressure monitoring point P1 is located in the discharge chamber 22, which is a most upstream section of the passage 36. Further, a downstream pressure monitoring point P2 is located in the passage 36 at a position spaced from the point P1 at a predetermined distance. The gas pressure PdH detected at the point P1 (the discharge pressure Pd) is introduced to the control valve CV via a first passage 37. The gas pressure PdL detected at the point P2 is introduced to the control valve CV via a second passage 38. The control valve CV mechanically detects the pressure difference ΔP(t) between the points P1 and P2 (ΔP(t)=PdH−PdL). The control valve CV adjusts its opening size in accordance with the detected pressure difference ΔP(t), thus executing a feedback control procedure for the compressor displacement.

Figure 3:
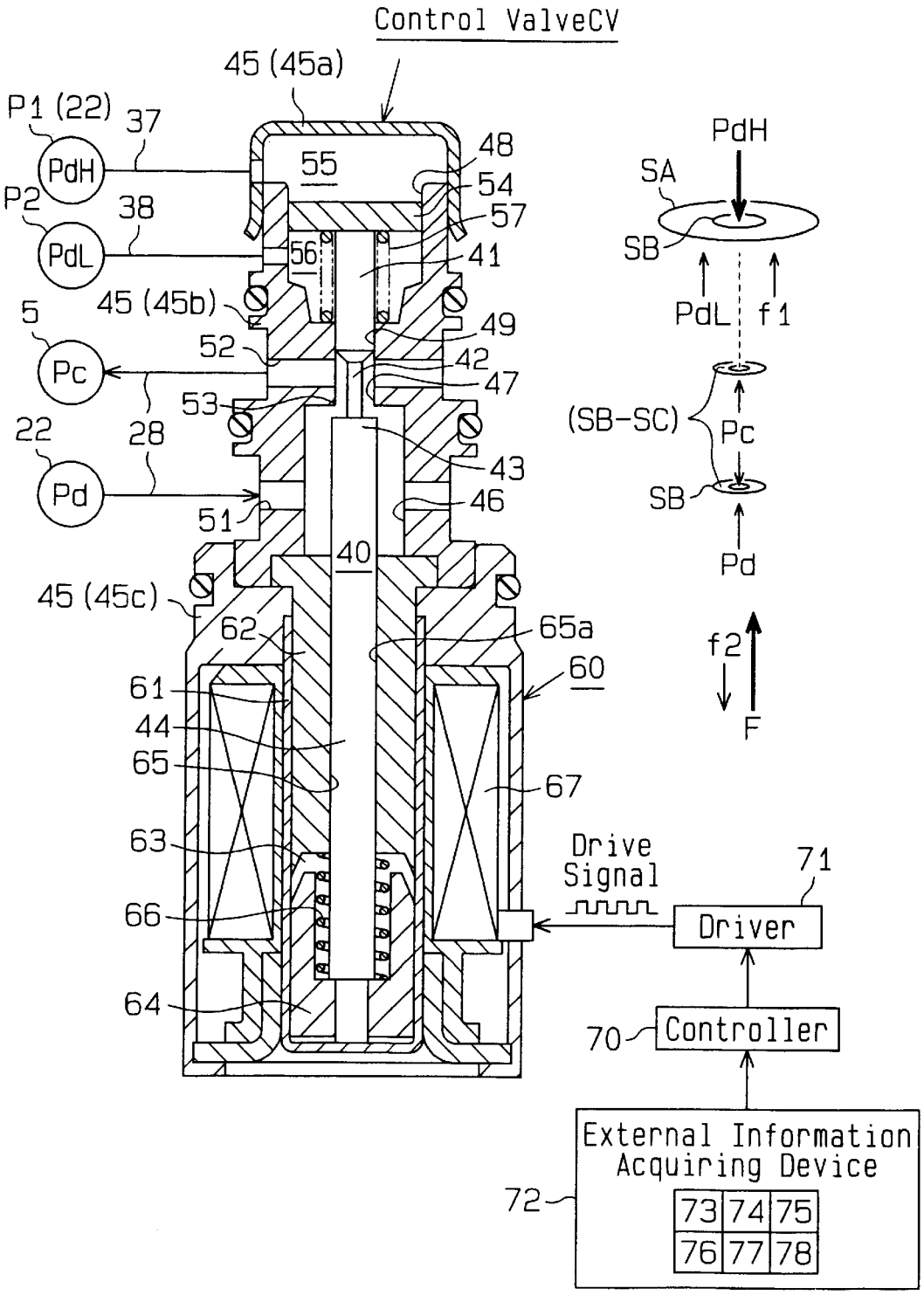
FIG. 3 is a cross-sectional view showing a control valve of the compressor of FIG. 2.

As shown in FIG. 3, the control valve CV includes an inlet valve portion located in an upper section of the valve CV and a solenoid portion 60 located in a lower section of the valve CV. The inlet valve portion adjusts the opening size (restriction size) of the supply passage 28 connecting the discharge chamber 22 to the crank chamber 5. The solenoid portion 60 is an electromagnetic urging mechanism that urges a movable rod 40 located in the control valve CV in accordance with an external, electric control signal. The movable rod 40 includes a distal portion 41, which receives the pressure difference ΔP(t), a connecting portion 42, a valve body 43, which is located substantially in the middle of the rod 40, and a guide rod section 44, which forms a proximal portion of the rod 40. The valve body 43 forms part of the guide rod section 44. The cross-sectional area of the distal portion 41 is defined as SB, that of the connecting portion 42 is defined as SC, and that of the guide rod section 44 (including the valve body 43) is defined as SD. In this case, the following equation is satisfied: SC<SB<SD.

A valve housing 45 of the control valve CV includes a lid 45*a*, an upper body section 45*b*, which substantially forms the contour of the inlet valve portion, and a lower body section 45*c*, which forms the contour of the solenoid portion 60. A valve chamber 46 and a communication passage 47 are formed in the upper body section 45*b*. A pressure sensitive chamber 48 is formed by the upper body section 45*b* and a lid 45*a* that is secured to an upper portion of the section 45*b*, as viewed in FIG. 3. The movable rod 40 extends through the valve chamber 46, the communication passage 47, and the pressure sensitive chamber 48 and moves in an axial direction (the vertical direction as viewed in FIG. 3). The valve chamber 46 is connected with the communication passage 47 when the rod 40 is located at a certain position. However, the communication passage 47 is blocked from the pressure sensitive chamber 48 by a partition (forming part of the valve housing 45) located between the passage 47 and the chamber 48. In other words, a guide hole 49 is formed in the partition for guiding the rod 40, and the diameter of the guide hole 49 is equal to the diameter of the distal portion 41 of the rod 40. Further, the communication passage 47 is formed by the guide hole 49, and the diameter of the communication passage 47 is equal to the diameter of the distal portion 41. Thus, the cross-sectional area of the rod 40, that of the communication passage 47 and that of the guide hole 49 are all SB.

As shown in FIG. 3, the valve chamber 46 has a bottom formed by an upper side of a fixed iron core 62, which will be described later. A port 51 extends radially through a wall section of the valve housing encompassing the valve chamber 46. The port 51 connects the discharge chamber 22 to the valve chamber 46 through an upstream section of the supply passage 28. In the same manner, a port 52 extends radially through a wall section of the valve housing encompassing the communication passage 47. The port 52 connects the communication passage 47 to the crank chamber 5 through a downstream section of the supply passage 28. Thus, in the control valve CV, the port 51, the valve chamber 46, the communication passage 47, and the port 52 form part of the supply passage 28 connecting the discharge chamber 22 to the crank chamber 5. The valve chamber 46 accommodates the valve body 43 of the movable rod 40. The diameter of the communication passage 47 is larger than the diameter of the connecting portion 42 of the rod 40 but smaller than the diameter of the guide rod section 44. A step between the valve chamber 46 and the communication passage 47 thus forms a valve seat 53, and the communication passage 47 functions as a valve hole. If the movable rod 40 is moved from the position of FIG. 3 (lowermost position) to an uppermost position at which the valve body 43 is received by the valve seat 53, the communication passage 47 is closed. In other words, the valve body 43 of the movable rod 40 functions as an inlet valve body that adjusts the opening size of the supply passage 28 to a desired degree.

A movable wall 54, or a partition, is provided in the pressure sensitive chamber 48 and moves axially in the chamber 48. The movable wall 54 axially divides the pressure sensitive chamber 48 into a pair of sections, which are a P1 pressure chamber (first pressure chamber) 55 and a P2 pressure chamber (second pressure chamber) 56. The movable wall 54 moves in accordance with the pressure difference between the P1 pressure chamber 55 and the P2 pressure chamber 56. The cross-sectional area of the movable wall 54 is defined as SA and is larger than the cross-sectional area SB of the communication passage 47 or the guide hole 49 (SB<SA). The P1 pressure chamber 55 is constantly connected to the discharge chamber 22 and the upstream pressure monitoring point P1 through the first passage 37. The P2 pressure chamber 56 is constantly connected to the downstream pressure monitoring point P2 through the second passage 38. That is, the discharge pressure Pd is applied to the P1 pressure chamber 55 and is referred to as the pressure PdH. The pressure PdL acting on the point P2 is applied to the P2 pressure chamber 56. Accordingly, an upper side of the movable wall 54 is exposed to the pressure PdH, and a lower side of the wall 54 is exposed to the pressure PdL, as viewed in FIG. 3. The distal portion 41 of the movable rod 40 projects into the P2 pressure chamber 56. The movable wall 54 is secured to a distal end of the distal portion 41. A buffer spring 57 is located in the P2 pressure chamber 56 for urging the movable wall 54 toward the P1 pressure chamber 55.

The solenoid portion 60 of the control valve CV includes an accommodating cylinder 61 having a closed end. The fixed iron core 62 is fitted in an upper section of the cylinder 61 to define a solenoid chamber 63 in the cylinder 61. The solenoid chamber 63 accommodates a movable iron core 64, which is also referred to as a plunger. The movable core 64 moves axially in the solenoid chamber 63. A guide hole 65 extends axially in the middle of the fixed core 62. The guide hole 65 receives the guide rod section 44 of the movable rod 40, which moves axially in the guide hole 65. A slight clearance, or a slit 65*a*, is formed between the wall of the guide hole 65 and the guide rod section 44. A valve chamber 46 is connected to the solenoid chamber 63 through the slit 65*a*. That is, the solenoid chamber 63 is exposed to the discharge pressure Pd, which also acts in the valve chamber 46. The solenoid chamber 63 receives the proximal portion of the movable rod 40. A proximal end of the guide rod section 44 extends in the solenoid chamber 63. This end of the guide rod section 44 is securely fitted in a hole formed in the middle of the movable core 64 through crimping. The movable rod 40 thus moves integrally with the movable core 64.

A return spring 66 is provided between the fixed core 62 and the movable core 64. The return spring 66 urges the movable core 64 away from the fixed core 62, thus pressing the movable core 64 and the movable rod 40 downward, as viewed in FIG. 3. The force f2 of the return spring 66 is greater than the force f1 of the buffer spring 57. The return spring 66 thus acts to return the movable core 64 and the movable rod 40 to a lowermost position (an initial position when current supply is nullified). A coil 67 is wound around the fixed core 62 and the movable core 64. The coil 67 is supplied with a drive signal sent from a driver 71 in response to an instruction of a controller 70. The coil 67 generates electromagnetic force F corresponding to current supply from the driver 71. The electromagnetic force F draws the movable core 64 toward the fixed core 62, thus moving the movable rod 40 toward the P1 pressure chamber 55. The current supply to the coil 67 may be determined by an analog current control procedure or a duty control procedure, in which a duty ratio Dt of the drive signal is altered as needed. In this embodiment, the duty control procedure is employed. The opening size of the control valve CV increases as the duty ratio Dt of the drive signal decreases. That is, the opening size of the control valve CV decreases as the duty ratio Dt of the drive signal increases.

The opening size of the control valve CV is determined in accordance with the position of the movable rod 40, which forms the valve body 43. The operational conditions and characteristics of the control valve CV are made clear by analyzing various forces acting on the movable rod 40.

Figure 4:
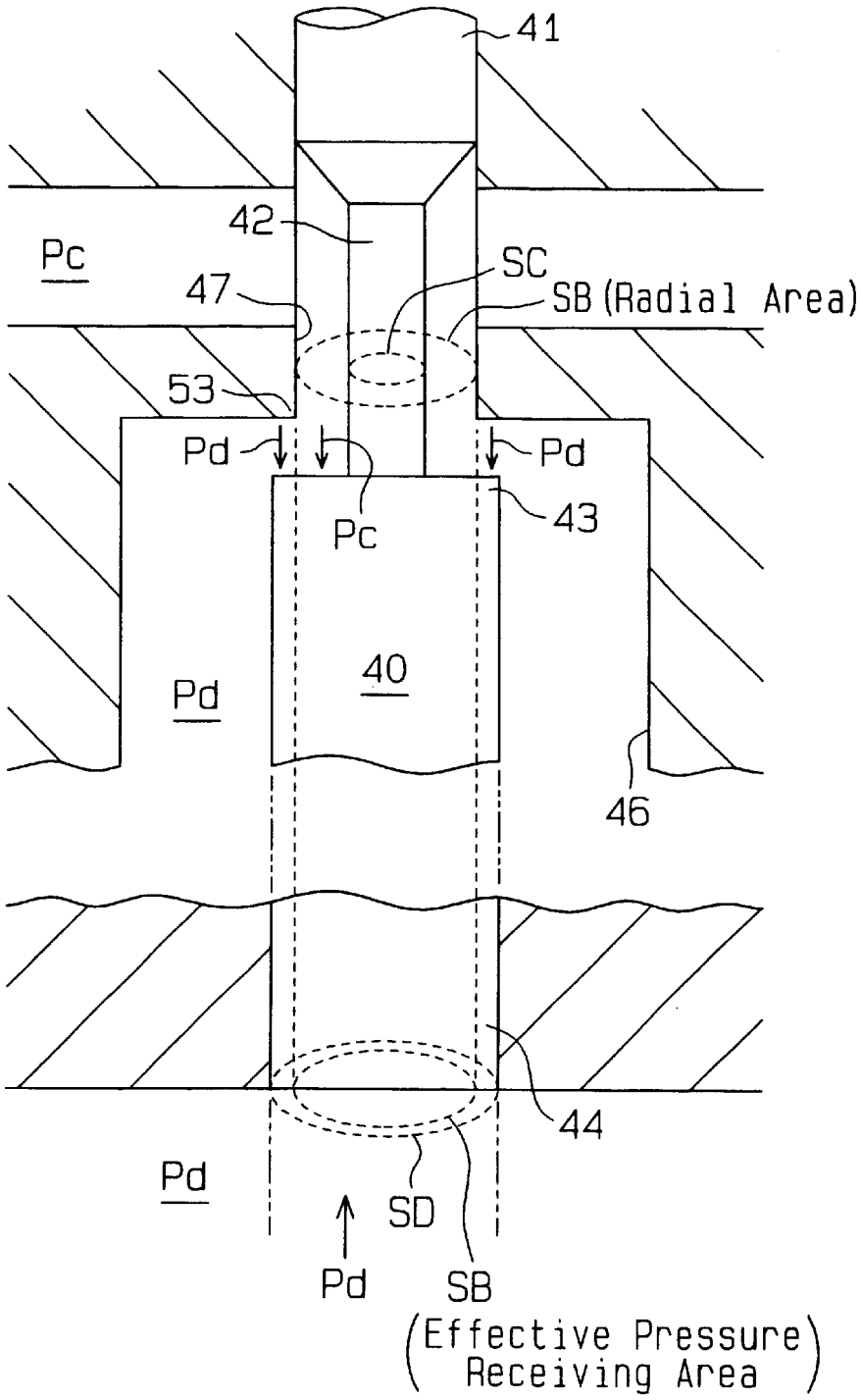
FIG. 4 is a cross-sectional view schematically explaining an effective pressure receiving area of the control valve of FIG. 3.

As viewed in FIG. 3, the upper side of the distal portion 41 of the rod 40 receives a downward force generated in accordance with the pressure difference between the points P1, P2 and diminished by the upward force f1 of the buffer spring 57. The pressure receiving area of the upper side of the movable wall 54 is SA, and the pressure receiving area of the lower side of the movable wall 54 is SA−SB. A lower side of the distal portion 41 (the pressure receiving area of-which is SB−SC) receives an upward force caused by the crank pressure Pc. Pressures acting on the valve body 43, the guide rod section 44, and the movable core 64 will hereafter be analyzed with reference to FIG. 4, which schematically shows pressures acting on the movable rod 40. As shown in FIG. 4, an imaginary cylindrical surface extending axially from the wall of the communication passage 47 (as indicated by broken lines) divides the upper side of the valve body 43 into a radially inner section and a radially outer section. The crank pressure Pc acts downward on the inner section (the area of which is SB−SC), and the discharge pressure Pd acts downward on the outer section (the area of which is SD−SB), as viewed in FIG. 4. Since the pressure acting on the upper side of the movable core 64 is equilibrated with the pressure applied to the lower side of the movable core 64, the discharge pressure Pd, to which the solenoid chamber 63 is exposed, urges the guide rod section 44 upward at an area corresponding to the cross-sectional area SD of the guide rod section 44. Further, as shown in FIG. 3, the guide rod section 44 of the movable rod 40 (including the valve body 43) receives the upward electromagnetic force F and the downward force f2 of the return spring 66, which acts against the electromagnetic force F.

When the control valve is operated, the movable rod 40 is positioned to satisfy the following condition: the total force acting on the movable rod 40 is zero. If the downward direction is defined as a positive direction, the following equation (1) is obtained based on the above condition:

$$PdH\cdot SA-PdL(SA-SB)-f1-Pc(SB-SC)+Pc(SB-SC)+Pd(SD-SB)-Pd\cdot SD-F+f2=0 \quad (1)$$

The following equation (2) is obtained from the equation (1):

$$(PdH-PdL)SA+PdL\cdot SB-Pd\cdot SB=F+f1-f2 \quad (2)$$

More specifically, while deriving equation (2) from equation (1), +Pd·SD is canceled by −Pd·SD such that Pd·SB remains in the equation (2). In other words, regarding the discharge pressure Pd, the effective pressure receiving area of the guide rod section 44 corresponds to the cross sectional area SB of the communication passage 47, regardless of the cross sectional area SD of the guide rod section 44. Thus, in this specification and the attached drawings, if the same type of pressure acts on opposite sides of a member such as a rod, the term "effective pressure receiving area" is defined as the pressure receiving area of one side of the member that has an uncanceled effect.

In this embodiment, since the pressure monitoring point P1 is located in the discharge chamber 22, the following equation is satisfied: Pd=PdH. If Pd of the equation (2) is substituted by PdH, the following equation (3) is obtained:

$$PdH-PdL=(F+f1-f2)/(SA-SB) \quad 3)$$

In the right side of the equation (3), f1, f2, SA, and SB are definite parameters that are determined when designing the control valve, while the electromagnetic force F is varied in accordance with the current supply to the coil 67. The equation (3) thus indicates the following two points. Firstly, the control valve CV determines a target value for the pressure difference ΔP(t) between the points p1 and P2 (PdH−PdL), or a target pressure difference TPD in relation to which the control valve CV adjusts its opening. The target value can be changed by an external duty control procedure for the coil 67. In other words, the control valve CV is externally controlled to alter the target pressure difference TPD. The target pressure difference TPD is determined by the solenoid portion 60, the buffer spring 57, and the return spring 66, as indicated by (F+f1−f2) in the equation (3). Secondly, the condition that the movable rod 40 is positioned to satisfy, or the equation (3), does not include pressure parameters (such as Pc and Pd) other than the pressure difference between the points P1 and P2 (PdH−PdL). The movable rod 40 is thus positioned regardless of the absolute value of the crank pressure Pc and that of the discharge pressure Pd. That is, pressure parameters other than the pressure difference between the points P1 and P2 (PdH−PdL) do not affect movement of the movable rod 40. The control valve CV is thus smoothly operated only in accordance with the pressure difference ΔP(t) between the points P1 and P2, the electromagnetic force F, the spring force f1, and the spring force f2.

The opening size of the control valve CV that has the above operational characteristics is determined as follows. If the current supply to the coil 67 is null (Dt=zero), the force of the return spring 66 is stronger than the force of the buffer spring 57. The spring 66 thus acts to locate the movable rod 40 at the lowermost position shown in FIG. 3. In this state, the valve body 43 of the movable rod 40 is spaced from the valve seat 53 by a maximum distance. The inlet valve portion is thus completely open. However, if the current supply to the coil 67 is in accordance with a minimum duty ratio, at least the upward electromagnetic force F becomes stronger than the downward force f2 of the return spring 66. An upward force (F−f2) is thus generated by the solenoid portion 60 and acts against a downward force generated in accordance with the pressure difference (PdH−PdL), which is diminished by the upward force f1 of the buffer spring 57. Accordingly, the valve body 43 of the movable rod 40 is positioned with respect to the valve seat 53 to satisfy the equation (3), thus determining the opening size of the control valve CV. This determines the amount of the refrigerant supplied to the crank chamber 5 through the supply passage 28. The crank pressure Pc is thus adjusted in accordance with the refrigerant flow in the supply passage 28 and that of the bleed passage 27, which releases gas from the crank chamber 5. In other words, if the opening size of the control valve CV is adjusted, the crank pressure Pc is adjusted. Further, as long as the electromagnetic force F remains unchanged, the control valve CV functions as a constant flow valve that determines the target pressure difference TPD in accordance with the current electromagnetic force F. However, if the electromagnetic force F is varied in accordance with the external control procedure to alter the target pressure difference TPD, the control valve CV functions as a variable displacement control valve.

Electronic Control System and Its Procedure

As shown in FIGS. 1 and 3, the air conditioning apparatus includes the controller 70 that controls the air conditioning apparatus as a whole. The controller 70 is a computer-like control unit having a central processing unit (CPU), a read-only memory (ROM), a random-access memory (RAM), and an input/output interface (I/O interface). The driver 71 is connected to an output terminal of the I/O interface, and an external information acquiring device 72 is connected to an input terminal of the I/O interface. The controller 70 operates to determine the target duty ratio and to switch the operational mode of the compressor. More specifically, the controller 70 computes a tentative duty ratio DtP (corresponding to a "target duty ratio") and a final duty ratio Dt in accordance with at least various external information supplied by the external information acquiring device 72. The controller 70 performs an internal computation based on the tentative duty ratio DtP and outputs the final duty ratio Dt to the driver 71. That is, the controller 70 instructs the driver 71 to send a drive signal with the final duty ratio Dt to the coil 67. The electromagnetic force F of the solenoid portion 60 is altered in accordance with the duty ratio Dt of the drive signal supplied to the coil 67. Also, the target pressure difference TPD, according to which the control valve CV internally adjusts its opening size, is varied in accordance with the duty ratio Dt.

The external information acquiring device 72 includes various sensors such as an A/C switch 73, a temperature sensor 74, a temperature adjuster 75, a vehicle speed sensor 76, an engine speed sensor 77, and an accelerator position sensor 78. The A/C switch 73 is an ON/OFF switch manipulated by a driver or passenger to turn on and off the air conditioning apparatus. The temperature sensor 74 detects the passenger compartment temperature Te(t) (or the temperature of the air exiting from the evaporator, which is varied in relation to the passenger compartment temperature). The temperature adjuster 75 sets a desired temperature Te(set) for the passenger compartment (or the air exiting from the evaporator). The vehicle speed sensor 76 detects the vehicle speed, and the engine speed sensor 77 detects the engine speed. The accelerator position sensor 78 detects the opening size of a throttle valve provided in an engine intake manifold. The opening size of the throttle valve reflects the position of the accelerator, which is depressed by the driver.

The controller 70 executes a duty ratio control procedure for the control valve CV, as will hereafter be described with reference to the flowcharts of FIGS. 5 and 6.

Figure 5:
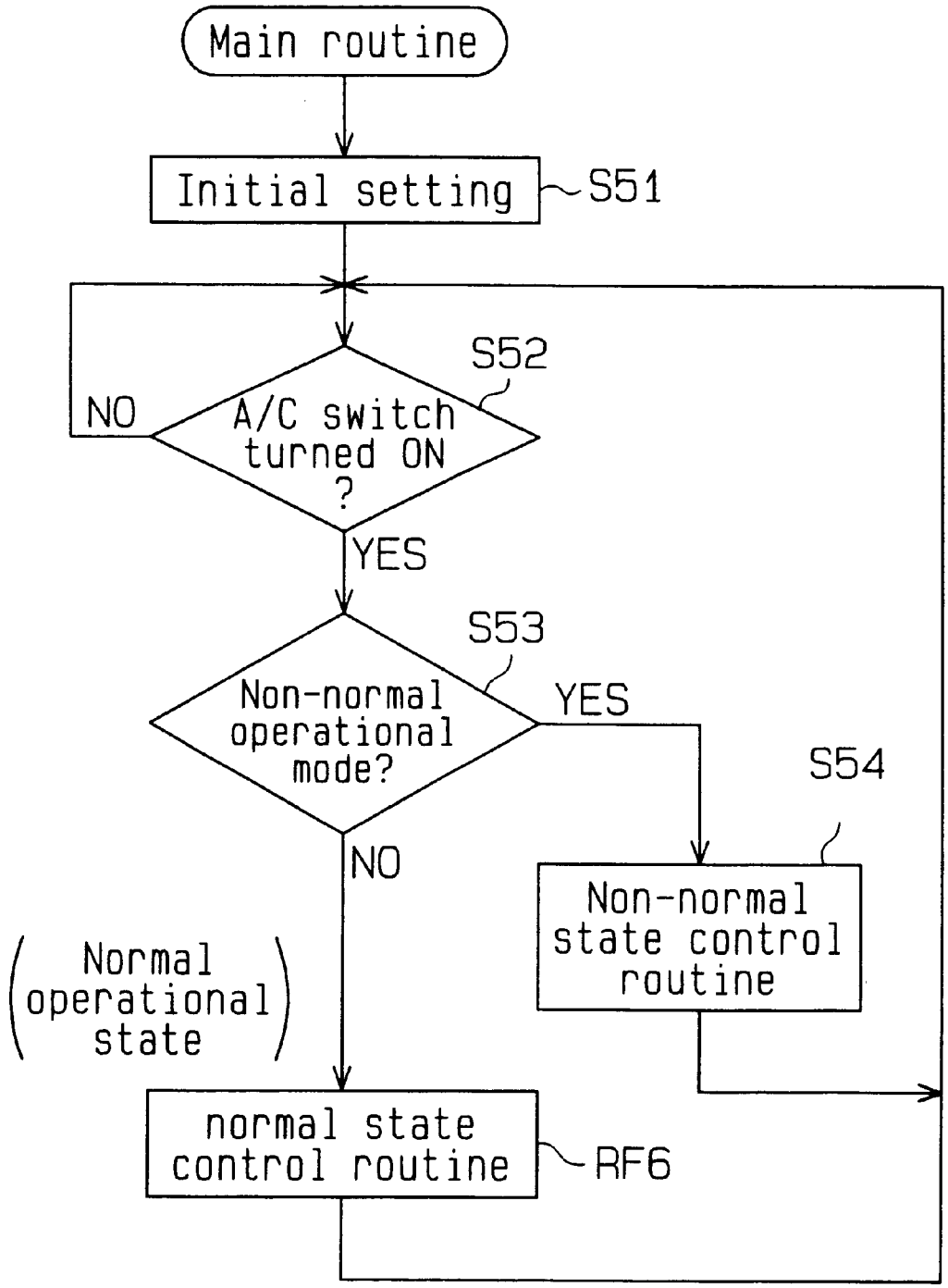
FIG. 5 is a flowchart showing a main routine of a displacement control procedure.

The flowchart of FIG. 5 shows a main routine of an air conditioning control program. When the ignition switch (or START switch) of the vehicle is turned on, the controller 70 is powered to initiate computation. In step S51 (hereinafter referred to simply as "S51", and other steps are referred to in the same manner), the controller 70 executes various initial settings in accordance with an initial program. For example, the tentative duty ratio DtP and the final duty ratio Dt are each set to a tentative value or an initial value. In the subsequent steps including S52, the controller 70 monitors the operational state of the vehicle and internally computes a duty ratio.

In S52, the controller 70 monitors the ON/OFF state of the A/C switch 73. When the A/C switch 73 is turned on, the controller 70 initiates an exceptional state determining routine (S53). In S53, the controller 70 judges whether the vehicle is operating in an exceptional state, or an exceptional mode, in accordance with the external information. The term "exceptional mode" indicates a state in which the vehicle, for example, is climbing a slope, which applies an increased load to the engine E. The term also indicates a state in which the vehicle is accelerated for, for example, when passing another vehicle (or at least the driver is rapidly accelerating the vehicle). The controller 70 acquires the detected accelerator position from the external information acquiring device 72 and compares the value with a predetermined reference value. In this manner, the controller 70 determines that the vehicle is operating in the increased load state or the accelerated state (the exceptional state).

If the judgement of S53 is positive, or if the vehicle is operated in the exceptional state, the controller 70 performs an exceptional state control procedure (S54). More specifically, the controller 70 maintains the final duty ratio Dt at zero or a minimum duty ratio Dt(min) during a predetermined time period Δt after detecting the exceptinal state. During the time period Δt, in which the final duty ratio Dt is minimized, the control valve CV is fully opened (maximum opening size), regardless of the pressure difference (PdH−PdL) between the points P1 and P2. The crank pressure Pc is thus rapidly increased, and the inclination angle θ is quickly minimized to minimize the compressor displacement. This reduces the load acting on the engine E, and makes additional engine power available for driving the vehicle. Although the cooling performance of the air conditioning apparatus is temporarily lowered during the time period Δt, which is relatively short, passenger' comfort is not significantly sacrificed in most cases.

If any judgement conditions for the exceptional state determining routine are not satisfied, the judgement of S53 becomes negative. In this case, it is determined that the vehicle is operating in a normal state, or a normal operational mode. The term "normal operational mode" indicates a state in which any judgement conditions for the non-normal state determining routine are not satisfied and it is assumed that the vehicle is operated in a normal state. When the judgement of S53 is negative, the controller 70 initiates a normal state control routine RF6. In many cases, the controller 70 first performs the normal state control routine RF6 and then resumes S52 of the main routine of FIG. 5.

Figure 6:
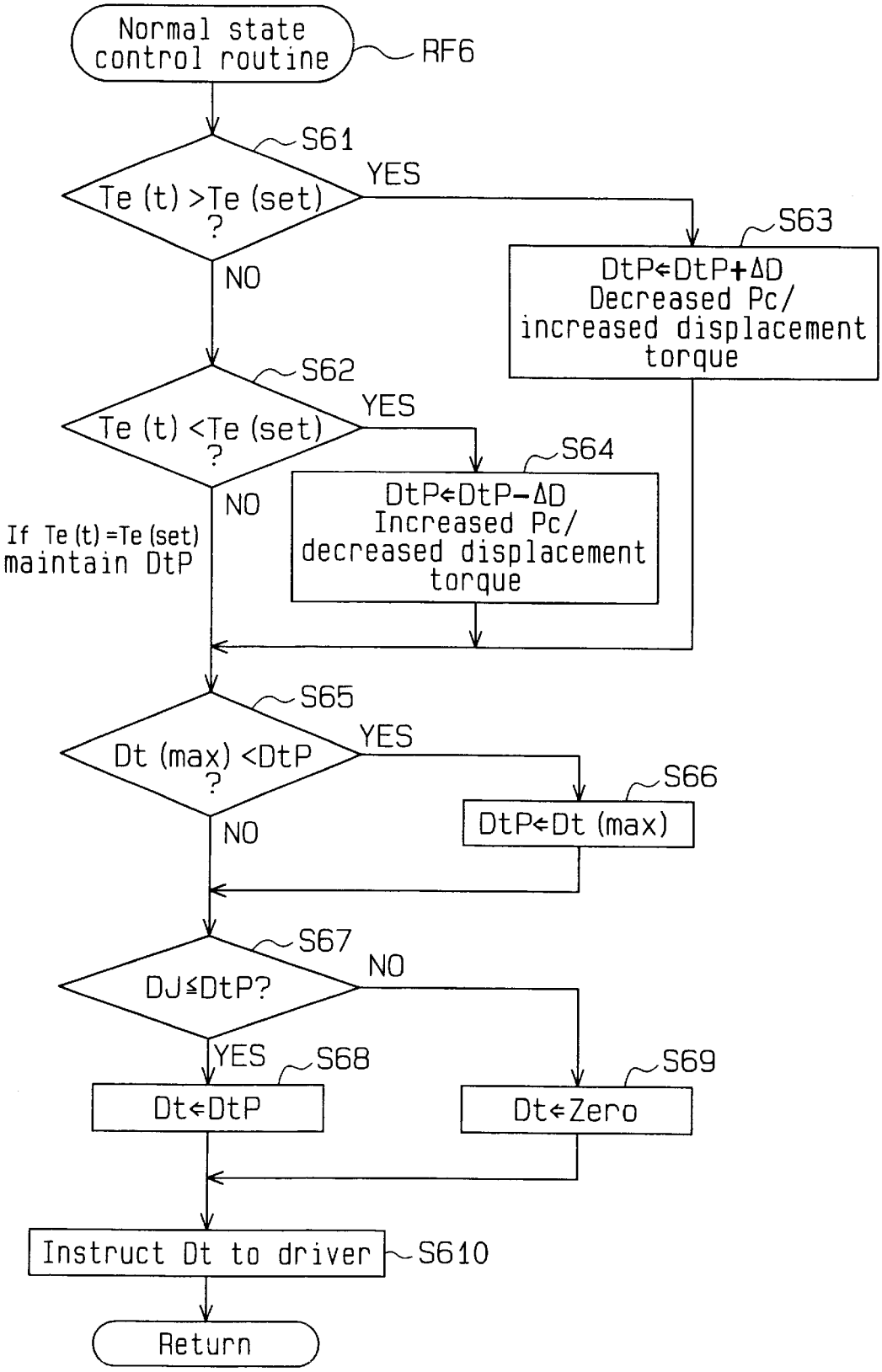
FIG. 6 is a flowchart showing a normal control routine of the procedure.

As shown in FIG. 6, if the vehicle is operated in the normal operational mode, the controller 70 executes a feedback control procedure for the air conditioning performance, or the compressor displacement, in accordance with the normal state control routine RF6. The control valve CV, which includes the movable wall 54 that is exposed to the pressure difference ΔP(t), adjusts its opening size mechanically or internally in accordance with variation in the pressure difference ΔP(t) (PdH−PdL). Thus, while executing the routine RF6, the controller 70 corrects the target pressure difference TPD of the control valve CV in relation to the thermal load currently acting on the evaporator 33. In other words, the controller 70 regressively corrects the tentative duty ratio DtP for the internal computation and determines the final duty ratio Dt, which is sent to the driver 71, in accordance with the corrected tentative duty ratio DtP.

More specifically, in S61, the controller 70 judges whether the temperature Te(t) detected by the temperature sensor 74 exceeds the target temperature Te(set) set by the temperature adjuster 75. If the judgement of S61 is negative, the controller 70 judges whether the detected temperature Te(t) is lower than the target temperature Te(set) in S62. If the judgement of S62 is also negative, it is indicated that the detected temperature Te(t) is equal to the target temperature Te(set). In this case, the cooling performance of the compressor need not be corrected, and the tentative duty ratio DtP remains unchanged.

If the judgement of S61 is positive, it is assumed that the passenger compartment temperature is relatively high and the cooling load acting on the compressor has increased. Thus, the controller 70 increases the tentative duty ratio DtP by a unit amount ΔD in S63. When the duty ratio of the drive signal is altered to the increased value (DtP+ΔD), the electromagnetic force F generated by the solenoid portion 60 is increased accordingly, thus increasing the target pressure difference TPD of the control valve CV. In this state, the force resulting from current pressure difference ΔP(t) does not equilibrate the upward urging force and the downward urging force acting on the movable rod 40. The movable rod 40 is thus moved toward the P1 pressure chamber 55 such that the downward force f2 of the return spring 66 matches the increased upward electromagnetic force F. Accordingly, the valve body 43 of the movable rod 40 is repositioned to satisfy the equation (3). This reduces the opening size of the control valve CV (the supply passage 28) accordingly, thus lowering the crank pressure Pc. As a result, the difference between the crank pressure Pc and the pressure in the cylinder bore 1*a*, which act on opposite sides of the piston 20, decreases to increase the inclination angle of the swash plate 12. This increases the compressor displacement, thus increasing the load acting on the engine. With the displacement increased, the cooling performance of the evaporator 33 is improved, which lowers the passenger compartment temperature Te(t). In this state, the pressure difference ΔP(t) between the pressure monitoring points P1 and P2 is increased. The opening size of the control valve CV is then reversely mechanically increased in a feedback manner.

If the judgement of S61 is negative and the judgement of S62 is positive, it is assumed that the passenger compartment temperature is relatively low and the cooling load acting on the compressor is decreased. Thus, the sag controller 70 reduces the tentative duty ratio DtP by a unit amount ΔD in S64. When the duty ratio of the drive signal is altered to the decreased value (DtP−ΔD), the electromagnetic force F generated by the solenoid portion 60 is reduced accordingly, thus decreasing the target pressure difference TPD of the control valve CV. In this state, the force resulting from the current pressure difference ΔP(t) does not equilibrate the upward urging force and the downward urging force acting on the movable rod 40. The movable rod 40 is thus moved away from the P1 pressure chamber 55 such that the downward force f2 of the return spring 66 matches the decreased upward electromagnetic force F. Accordingly, the valve body 43 of the movable rod 40 is repositioned to satisfy the equation (3). This increases the opening size of the control valve CV (the supply passage 28) accordingly, thus raising the crank pressure Pc. As a result, the difference between the crank pressure Pc and the pressure in the cylinder bore 1*a*, which act on opposite sides of the piston 20, increases to decrease the inclination angle of the swash plate 12. This reduces the compressor displacement, thus decreasing the load acting on the engine. When the displacement is decreased, the cooling performance of the evaporator 33 is decreased, which increases the passenger compartment temperature Te(t). In this state, the pressure difference ΔP(t) between the pressure monitoring points P1 and P2 is decreased. The opening size of the control valve CV is then reversely mechanically reduced in a feedback manner.

As described, if the detected temperature Te(t) is not equal to the target temperature Te(set), the controller 70 corrects the tentative duty ratio DtP in S63 and/or S64. This gradually optimizes the target pressure difference TPD of the control valve CV. The control valve CV thus internally adjusts its opening size in a feedback manner in accordance with the target pressure difference TPD. In this manner, the detected temperature Te(t) approaches the target temperature Te(set).

Further, in this embodiment, the controller 70 performs a procedure for restricting an upper limit of the tentative duty ratio DtP, after terminating S62, S63, or S64. This prevents the tentative duty ratio DtP from exceeding the maximum value Dt(max) of an acceptable variation range for the final duty ratio Dt. More specifically, the controller 70 judges whether the tentative duty ratio DtP is larger than the maximum duty ratio Dt(max) in S65. If the judgement of S65 is positive, the controller 70 reduces the tentative duty ratio DtP to the maximum duty ratio Dt(max) in S66. Accordingly, once the controller 70 terminates S65 or S66, the tentative duty ratio DtP is always equal to or smaller than the maximum duty ratio Dt(max).

Subsequently, the controller 70 judges whether the tentative duty ratio DtP is equal to or larger than a predetermined reference value DJ in S67. If the judgement of S67 is positive, the coefficient of performance COP obtained with the displacement corresponding to this tentative duty ratio DtP is satisfactory. That is, the reference value DJ indirectly indicates a displacement corresponding to a minimum value of a desired coefficient of performance, which is a threshold value of displacement (how to set the value DJ will be described later). Thus, if the judgement of S67 is positive, the tentative duty ratio DtP is selected as the final duty ratio Dt (see S68). In this case, in the subsequent step S610, the controller 70 instructs the driver 71 to send a drive signal representing the final duty ratio Dt to the coil 67. If the judgement of S67 is negative, or the tentative duty ratio DtP is smaller than the reference value DJ, the final duty ratio Dt is nullified (see S69). In the subsequent step S610, the controller 70 instructs the driver 71 to send a drive signal having the nullified final duty ratio Dt (Dt=zero) to the coil 67. In other words, if the tentative duty ratio DtP for the internal computation is smaller than the reference value DJ, the current supply to the coil 67 is substantially nullified.

In accordance with the flowchart shown in FIG. 6, particularly S67 to S610, the compressor displacement is varied continuously as long as a relatively high coefficient of performance COP is ensured. However, if the COP is likely to be relatively low, the compressor displacement is minimized, regardless of the tentative duty ratio for the internal computation. More specifically, the compressor operation is switched between a variable displacement operation and a minimum displacement operation based on the comparison between the tentative duty ratio DtP and the reference value DJ. Selection of the reference value DJ will hereafter be described by way of example.

Figure 7:
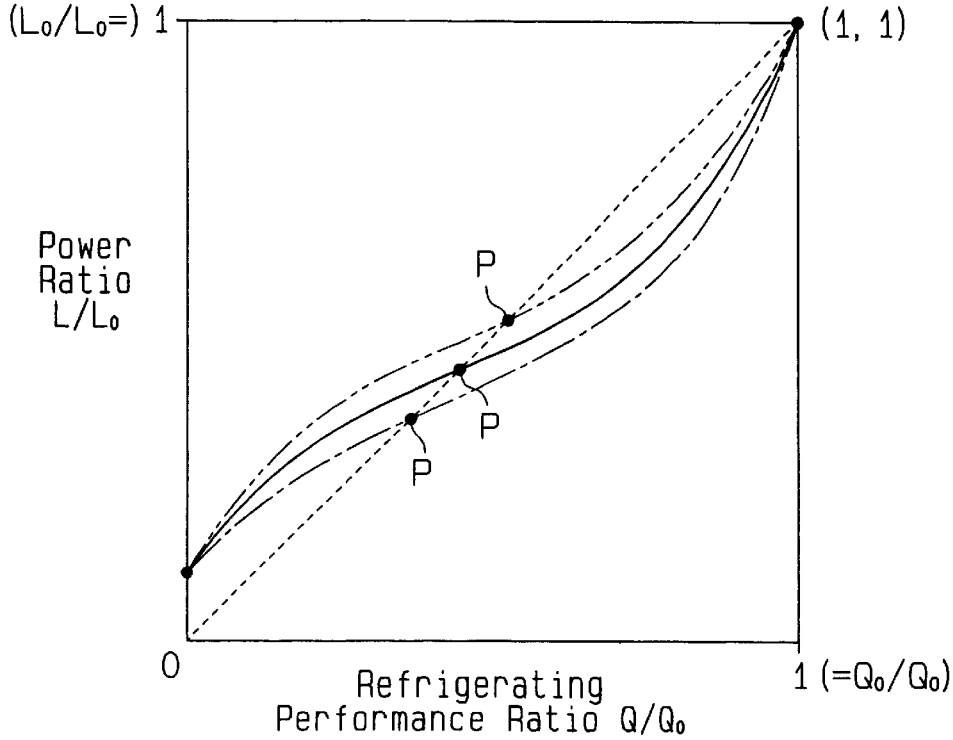
FIG. 7 is a graph showing a general variation of a refrigerating performance ratio in relation to a power ratio.
Figure 8:
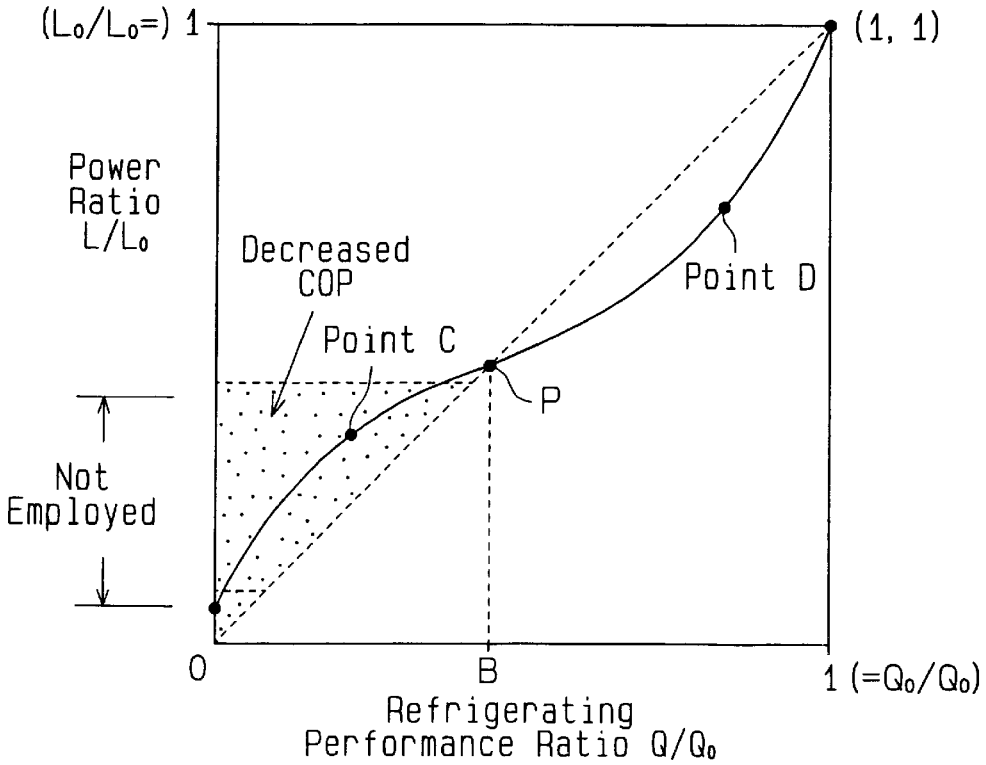
FIG. 8 is a graph corresponding to the graph of FIG. 7 regarding an embodiment of the present invention.
Figure 9:
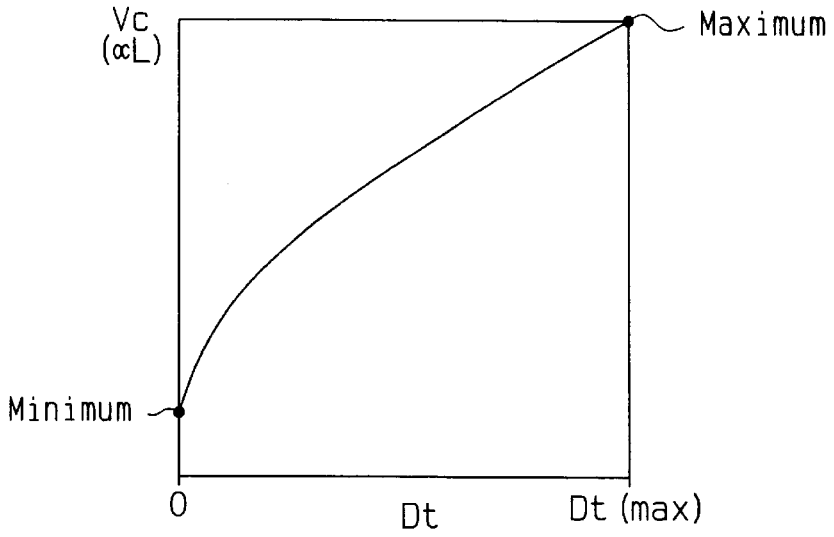
FIG. 9 is a graph showing variation of a duty ratio of a drive signal in relation to compressor displacement.
Figure 10:
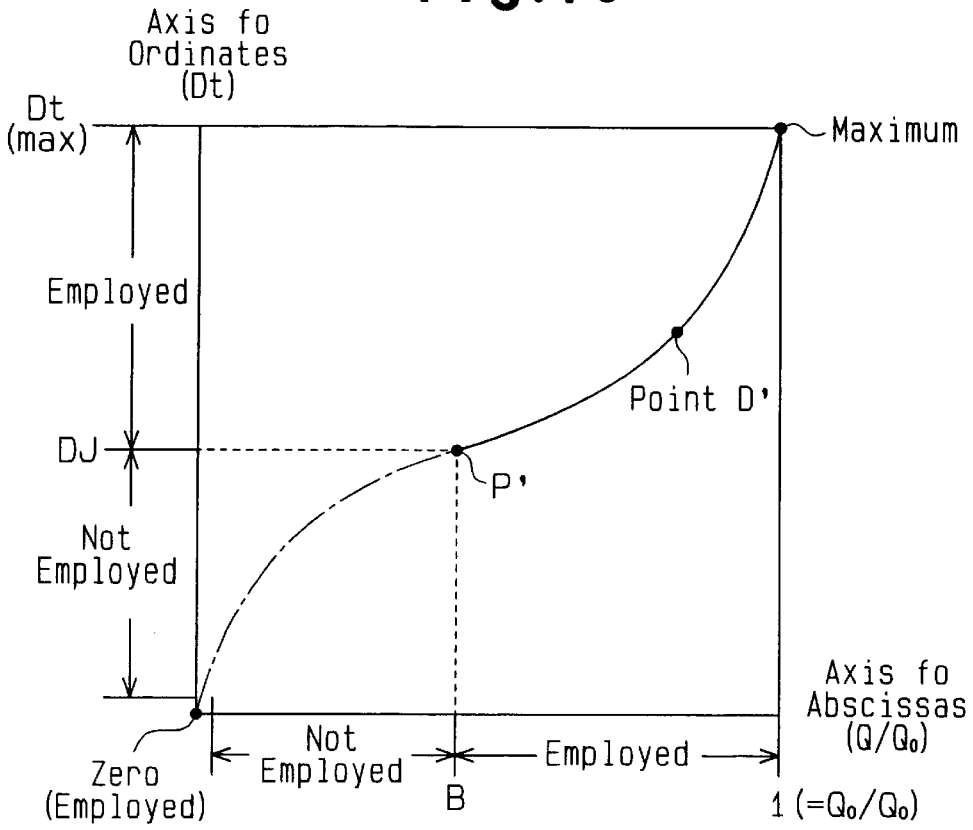
FIG. 10 is a graph showing variation of the refrigerating performance ratio in relation to the duty ratio.

FIG. 8 is a graph like to the graph of FIG. 7, but FIG. 8 includes only one curve representing the operational characteristics of the compressor. FIG. 9 is a graph showing the relationship between the actual duty ratio (the final duty ratio Dt) of the drive signal, which is sent to the coil 67, and the compressor displacement Vc. Since the power L required by the compressor increases as the displacement Vc increases, the graph of FIG. 9 also shows the relationship between the final duty ratio Dt and the power L indirectly. As shown in FIG. 9, although not linearly, the final duty ratio Dt is increased as the displacement Vc, or the power L, is increased. Considering this relationship between the duty ratio Dt and the power L, the vertical axis (y-axis) of FIG. 8 is changed from the power ratio to the duty ratio, thus obtaining the graph of FIG. 10. More specifically, in FIG. 10, the refrigerating performance ratio ($Q/Q_0$) is plotted along the horizontal axis and the final duty ratio Dt is plotted along the axis. The graph includes a curve having a single-dotted broken section and a solid section. The broken section is connected to the solid section by a point of inflection P'. As shown in FIG. 10, the refrigerating performance ratio corresponding to the point P' is defined as B. As shown in FIG. 8, the point of divergence P corresponds to the refrigerating performance ratio defined as B.

In this embodiment, the final duty ratio (DJ) corresponding to the point of inflection P' of FIG. 10 is selected as the reference value DJ, which is used for the judgement of S67.

More specifically, if the final duty ratio Dt is equal to the value DJ, the corresponding refrigerating performance ratio is B. As shown in FIG. 8, the COP corresponding to the refrigerating performance ratio B is the value indicated by the point P. As in the graph of FIG. 7, in an area below the point P of FIG. 8, or an area in which the displacement is lower than a value corresponding to the point P (indicated by the dotted area in FIG. 8), the COP is relatively low. Accordingly, in order to ensure a sufficient COP, it is preferred that the compressor displacement Vc is controlled to avoid an intermediate displacement between the minimum displacement corresponding to the nullified duty ratio (Dt=0) and the displacement corresponding to the point P. Instead, the compressor displacement Vc is minimized regardless of the tentative duty ratio DtP, if the value DtP is smaller than the reference value DJ. In other words, the reference value DJ is used to judge whether the tentative duty ratio DtP for the internal computation leads to a relatively low COP.

As indicated by the graph of FIG. 10, the refrigerating performance ratio is substantially nullified when the compressor is operated with the minimum displacement corresponding to the nullified duty ratio (Dt=0). However, as indicated by the graph of FIG. 8, the power ratio is not nullified even when the refrigerating performance ratio is nullified. In other words, as shown in FIG. 8, the point of the curve corresponding to the nullified duty ratio (Dt=0), at which the compressor is operated at the minimum displacement, is located slightly above from the diagonal straight line, thus indicating that the COP is relatively low. However, it is also indicated that this point of the curve is located relatively close to the diagonal line, although included in the dotted area, as compared to the point C, which is relatively spaced from the line. That is, the COP corresponding to the minimum displacement is still relatively close to the value $Q_0/L_0$ as compared to the COP corresponding to the point C, or higher than the COP corresponding to the point C. Accordingly, in order to ensure a relatively high COP, or a relatively high efficiency, it is advantageous to minimize the displacement if the operational state corresponds to the area below the point P of FIG. 8.

Figure 11:
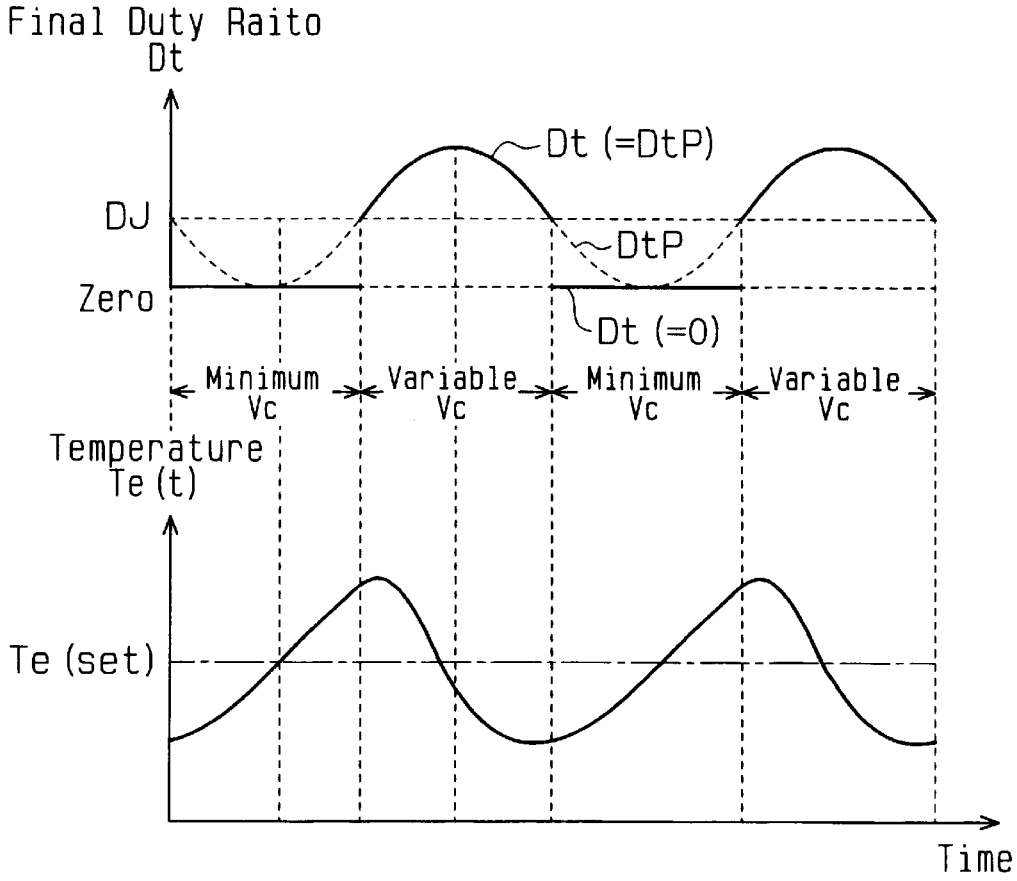
FIG. 11 is a timing chart showing an example of variation of the duty ratio and variation of a passenger compartment temperature.

FIG. 11 is a timing chart (in which curves are simplified for convenience of understanding) showing the variation of the final duty ratio Dt and the detected temperature Te(t) during the normal control routine of FIG. 6 performed when the target temperature Te (set) is maintained at a constant level. As shown in FIG. 11, a period in which the final duty ratio Dt is zero alternates with a period in which the final duty ratio Dt is equal to or greater than the reference value DJ. During the period in which the final duty ratio Dt is zero, the displacement Vc of the compressor is no longer variably controlled but is minimized. In contrast, during the period in which the final duty ratio Dt is equal to or greater than the reference value DJ, the displacement Vc of the compressor is variably controlled. While the displacement Vc is controlled in accordance with these alternate periods, the detected temperature Te(t) increases when the displacement Vc is maintained at minimum. However, if the variable control of the displacement Vc is resumed, the detected temperature Te(t) starts to decrease with a relatively short delay. However, the detected temperature Te(t) starts to increase again, toward the target temperature Te(set), without decreasing excessively. In this manner, the passenger compartment temperature is steered foward the target temperature Te(set) though is has slight fluctuation and varies in a relatively small range around the target value Te(set).

This embodiment has the following effects.

The tentative duty ratio DtP for the internal computation of the controller 70, in which regressive computations are repeated, is considered to be a parameter that indirectly indicates the compressor displacement Vc, or the refrigerant flow in the refrigerant circuit. Thus, if the current tentative duty ratio DtP is compared with the reference value DJ, it is judged whether the coefficient of performance (COP) in a corresponding operational state (displacement Vc) is relatively high or low. Based on this judgement, the compressor operation is switched between the minimum displacement operation and the variable displacement operation. That is, the variable control of the displacement is avoided when the COP is likely to decrease below a minimum acceptable level (in this embodiment, $Q_0/L_0$) This improves the operation efficiency of the compressor and that of the air conditioning apparatus.

In this embodiment, the compressor displacement is controlled in a feedback manner by directly controlling the pressure difference ΔP(t) between the points P1 and P2 (PdH−PdL). Accordingly, regardless of the thermal load acting on the evaporator 33, the displacement is decreased quickly and reliably in response to an external control procedure, as needed when the engine is in the exceptional state.

When the vehicle is operated in the normal operational mode, the tentative duty ratio DtP for determining the target pressure difference TPD is automatically adjusted in relation to the detected temperature Te(t) and the target temperature Te(set). Further, the control valve internally adjusts its opening size in accordance with the pressure difference ΔP(t) between the points P1 and P2. This controls the compressor displacement. In other words, the air conditioning apparatus adjusts the compressor displacement to reduce the difference between the detected temperature Te(t) and the target temperature Te(set), to make the passenger compartment comfortable.

The present invention may be modified as follows.

In the illustrated embodiment, the reference value DJ, on which the compressor operation of switching between the minimum displacement operation and the variable displacement operation, is based, is a predetermined value (a fixed value). However, the reference value DJ may be varied during the control procedure. For example, the reference value DJ may be corrected in accordance with external information including the engine speed, the flow rate of air through the evaporator, the atmospheric temperature, and the insolation amount. The judgement of S67 is performed in accordance with the corrected reference value DJ.

In the illustrated embodiment, the reference value DJ is selected as the final duty ratio Dt for achieving the maximum performance COP($COP=Q_0/L_0$), as indicated by the point P of FIG. 8, which corresponds to the point P' of FIG. 10. However, the reference value DJ may be any value corresponding to a final duty ratio Dt that achieves an intermediate compressor displacement Vc that divides a displacement variation range into a large displacement area and a small displacement area. In other words, the reference value DJ may be any value, as long as the COP corresponding to the value DJ is considered to be a minimum acceptable COP. The variable controlling of the displacement is suspended when necessary to avoid a COP lower than the minimum acceptable COP, thus satisfying the objective of the present invention.

In the illustrated embodiment, if the tentative duty ratio DtP is equal to or greater than the reference value DJ, the compressor displacement is varied continuously by altering the target pressure difference TPD of the control valve CV. However, even if the tentative duty ratio DtP is equal to or greater than the reference value DJ, the compressor may be operated by a predetermined fixed displacement corresponding to a predetermined COP, for example, a fixed displacement corresponding to the COP indicated by the point D of FIG. 8. That is, the duty ratio is fixed to a value corresponding to the point D' of FIG. 10, which corresponds to the point D. In this case, the final duty ratio Dt of the drive signal is switched between two values, which are zero and the value corresponding to the point D'. This still suppresses variable displacement operation in a relatively small displacement area, when COP is relatively low.

In the illustrated embodiment, the two pressure monitoring points P1 and P2 are located along the passage 36 connecting the discharge chamber 22 of the compressor to the condenser 31. Instead, the points P1 and P2 may be located along the passage 35 connecting the evaporator 33 to the suction chamber 21 of the compressor. Alternatively, the upstream point P1 may be located in the discharge chamber 22 or the passage 36, and the downstream point P2 may be located in the suction chamber 21 or the passage 35. Further, the point P1 may be located in the discharge chamber 22 or the passage 36, and the point P2 may be located in the crank chamber 5. In addition, the point P1 may be located in the crank chamber 5, and the point P2 may be located in the suction chamber 21 or the passage 35. In any case, the pressure difference $\Delta P(t)$ between the points P1 and P2 reflects the amount of the refrigerant flowing in the refrigerant circuit, or the compressor displacement.

Although the illustrated embodiment is applied to a so-called clutchless compressor, the present invention may be applied to a variable displacement compressor to which power is transmitted from an engine E through a power transmitting mechanism PT having a clutch such as an electromagnetic clutch. In this case, it is preferred that the controller 70 minimizes the compressor displacement, regardless of the tentative duty ratio DtP, and disconnects the clutch if the tentative duty ratio DtP is smaller than the reference value DJ. Alternatively, it is preferred that the controller 70 disconnects the clutch immediately if the tentative duty ratio DtP is smaller than the reference value DJ, instead of minimizing the compressor displacement. That is, if it is assumed that the COP of the compressor is likely to drop, the power supply to the compressor is stopped by disconnecting the clutch.

The present invention may be applied to a prior-art variable displacement compressor that varies its displacement in accordance with suction pressure.

In this specification, the term "refrigerant circuit" indicates, as shown in FIG. 1, the circuit including the condenser 31, the expansion valve 32, the evaporator 33, and the compressor (including the suction chamber 21, the cylinder bores 1*a*, and the discharge chamber 22). In this regard, the cylinder bore 1*a*, which performs suction, compression, and discharge of refrigerant gas, forms part of the refrigerant circuit.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A variable displacement compressor, the displacement of which varied in a range including a minimum displacement and a maximum displacement, comprising:

an acquiring device for acquiring a target value used for controlling the compressor displacement;

a switching device that compares the target value with a predetermined reference value and switches an operational mode in accordance with the result of the comparison such that the displacement that corresponds to the target value results in a coefficient of performance that is equal to or greater than a predetermined level of a coefficient of performance;

an actuator for varying the displacement in accordance with at least an instruction from the switching device; and the switching device permits the actuator to perform a displacement control procedure for achieving the target value if the displacement corresponding to the target value is equal to or greater than a threshold displacement value corresponding to the reference value, and the switching device forces the actuator to perform the minimum displacement operation, regardless of the target value, if the displacement corresponding to the target value is smaller than the threshold displacement value.

2. The variable displacement compressor as set forth in claim 1, wherein:

the reference value is selected such that the threshold displacement value is an intermediate value between the maximum displacement and the minimum displacement, and the threshold displacement value results in a coefficient of performance equal to or greater than a level that corresponds to the maximum displacement.

3. The variable displacement compressor as set forth in claim 1, the compressor is part of an air conditioning apparatus, and the air conditioning apparatus includes a condenser, a pressure reducing device and an evaporator.

4. A variable displacement compressor, the displacement of which varied in a range including a minimum displacement and a maximum displacement, comprising:

an acquiring device for acquiring a target value used for controlling the compressor displacement;

a switching device that compares the target value with a predetermined reference value and switches an operational mode in accordance with the result of the comparison such that the displacement that corresponds to the target value results in a coefficient of performance that is equal to or greater than a predetermined level of a coefficient of performance;

an actuator for varying the displacement in accordance with at least an instruction from the switching device;

wherein the compressor is driven by an external drive source through a power transmitting mechanism, which has a clutch controlled by the switching device;

the switching device permits the actuator to perform the displacement control procedure for achieving the target value while engaging the clutch, if the displacement corresponding to the target value is equal to or greater than a threshold displacement value that corresponds to the reference value; and the switching device forces the actuator to perform the minimum displacement operation and/or disconnects the clutch regardless of the target value if the displacement that corresponds to the target value is smaller than the threshold displacement value.

5. A variable displacement compressor, the displacement of which varied in a range including a minimum displacement and a maximum displacement, comprising:

a crank chamber defined in the compressor;

an acquiring device for acquiring a target value used for controlling the compressor displacement;

a switching device that compares the target value with a predetermined reference value and switches an operational mode in accordance with the result of the comparison such that the displacement that corresponds to the target value results in a coefficient of performance that is equal to or greater than a predetermined level of a coefficient of performance;

an actuator for varying the displacement in accordance with at least an instruction from the switching device;

wherein the compressor varies the displacement by adjusting the pressure of the crank chamber; and the actuator is a control valve for controlling the pressure in the crank chamber, and the control valve senses a pressure difference between a pair of pressure monitoring points located in a refrigerant circuit and uses a force caused by the pressure difference as a mechanical input for internally adjusting the opening size of the valve, wherein the control valve varies a target value of pressure difference for internal adjustment of the opening size in accordance with an external electric control procedure.

6. The variable displacement compressor as set forth in claim 5, wherein:

the acquiring device is electrically connected with a temperature sensor for detecting a passenger compartment temperature that varies in relation with a temperature adjuster for setting a desired temperature; and the acquiring device computes the target value of the pressure difference in accordance with a comparison between the passenger compartment temperature detected by the temperature sensor and the temperature set by the temperature adjuster.

7. A method for controlling the displacement of a variable displacement compressor, wherein the compressor varies the displacement in a range from a minimum displacement to a maximum displacement by adjusting the pressure of a crank chamber, defined in the compressor, using a control valve, wherein the control valve varies a target pressure difference in accordance with an electric control procedure executed by a control device, the method comprising:

selecting an intermediate displacement in the variation range as a threshold displacement value;

judging whether the displacement is likely to be equal to or greater than the threshold displacement value or smaller than the threshold displacement value;

permitting a variable displacement operation, in which the target pressure difference is altered, if the displacement is likely to be equal to or greater than the threshold displacement value; and performing a minimum displacement operation if the displacement is likely to be smaller than the threshold displacement value.

* * * * *

UNITED STATES PATENT AND TRADEMARK OFFICE

CERTIFICATE OF CORRECTION

PATENT NO. : 6,537,037 B2
DATED : March 25, 2003
INVENTOR(S) : Masaki Ota et al.

It is certified that error appears in the above-identified patent and that said Letters Patent is hereby corrected as shown below:

Column 13,
Lines 23-24, please change “Thus, the sag controller 70” to -- Thus, the controller 70 --.

Signed and Sealed this

Fifteenth Day of July, 2003

JAMES E. ROGAN
*Director of the United States Patent and Trademark Office*